US011227730B2

(12) United States Patent
Pizzato

(10) Patent No.: US 11,227,730 B2
(45) Date of Patent: Jan. 18, 2022

(54) MODULAR STRUCTURE FOR SAFETY SWITCHES FOR ACCESS CONTROL

(71) Applicant: PIZZATO ELETTRICA S.R.L., Marostica (IT)

(72) Inventor: Marco Pizzato, Marostica (IT)

(73) Assignee: PIZZATO ELETTRICA S.R.L., Marostica (IT)

( * ) Notice: Subject to any disclaimer, the term of this patent is extended or adjusted under 35 U.S.C. 154(b) by 0 days.

(21) Appl. No.: 16/305,397

(22) PCT Filed: May 26, 2017

(86) PCT No.: PCT/IB2017/053133
§ 371 (c)(1),
(2) Date: Nov. 29, 2018

(87) PCT Pub. No.: WO2017/208126
PCT Pub. Date: Dec. 7, 2017

(65) Prior Publication Data

US 2019/0206637 A1 Jul. 4, 2019

(30) Foreign Application Priority Data

May 30, 2016 (IT) ..... 102016000055787

(51) Int. Cl.
*H01H 9/28* (2006.01)
*H01H 3/02* (2006.01)
(Continued)

(52) U.S. Cl.
CPC ..... *H01H 9/28* (2013.01); *H01H 3/022* (2013.01); *H01H 27/002* (2013.01); *H01H 27/06* (2013.01)

(58) Field of Classification Search
CPC ..... H01H 13/04; H01H 3/02; H01H 13/14; H01H 27/06; H01H 3/161; H01H 27/002;
(Continued)

(56) References Cited

U.S. PATENT DOCUMENTS

2015/0109712 A1* 4/2015 Pizzato ..... H01H 47/001 361/191
2016/0133416 A1* 5/2016 Pizzato ..... H03K 17/945 361/142
2016/0156351 A1* 6/2016 Pizzato ..... H03K 17/95 307/326

* cited by examiner

*Primary Examiner* — Ahmed M Saeed
(74) *Attorney, Agent, or Firm* — Mark M. Friedman

(57) ABSTRACT

A modular structure for safety switches for controlling access for machines and industrial plants comprises a casing (2) housing switching means for controlling one or more circuits of the machine or plant, drive means adapted to interact with the switching means upon the opening/closing of the access, an auxiliary module (3-3$^{v}$) housing at least one control (4$^{i}$-4$^{v}$) adapted to be manually operated to operate on the switching means and/or the drive means and comprising a box hollow body (5) having at least one opening (6) for inserting the control (4$^{i}$-4$^{v}$) provided with first means for removably connecting the control (4$^{i}$-4$^{v}$), the latter being selected within a series of controls (4$^{i}$-4$^{v}$) having functions different from each other and each provided with a fastening rod (7$^{i}$-7$^{v}$) adapted to be inserted in the opening (6) of the box body (5) and provided with second connecting means complementary to the first connecting means.

12 Claims, 6 Drawing Sheets

(51) Int. Cl.
*H01H 27/00* (2006.01)
*H01H 27/06* (2006.01)

(58) Field of Classification Search
CPC ..... H01H 3/022; H01H 27/007; H01H 50/32; H01H 2223/024; H01H 2223/028; H01H 50/02; H01H 9/0207; H01H 19/62; H01H 2003/0246; H01H 2300/026; H01H 3/14; H01H 9/04; H01H 9/28
See application file for complete search history.

B-B

A-A

B-B

A-A

B-B

A-A

B-B

A-A

B-B

A-A

B-B

A-A

MODULAR STRUCTURE FOR SAFETY SWITCHES FOR ACCESS CONTROL

TECHNICAL FIELD

The present invention is applicable in the field of electrical devices for industrial use and it particularly relates with a modular structure for safety switches for controlling access of industrial machines and plants applicable to movable protections such as barriers, shelters, inspection panels or the like.

STATE OF THE ART

Known switches for controlling access or barriers repair and/or safety perimeters for industrial machines or plants generally comprise a switching device anchored to the fixed part of the access and an actuator device anchored to the movable part.

Such switches have the aim of blocking the plant upon the opening of the access for obvious safety reasons, while activating one or more signaling or service circuits. Likewise, the switches can allow the machine or system to restart immediately after the access has been closed unless there is a condition requiring a specific operator intervention.

The control of the switching means for opening and closing the power supply circuit of the machine or plant can be carried out either by means of a mechanical or electronic actuator.

The first type switches, an example of which is disclosed in EP2112674 in the name of the same applicant, are usually provided with a key actuator associated with the movable device and adapted to be inserted into a slot of the switching device to interact with a driving mechanism of switching means for opening/closing the supply circuit and any auxiliary circuits.

The aforementioned patent also has a centering system consisting of a centering pin associated with the movable actuator device, also provided with a key actuator, and designed to fit into a centering hole provided in a special block mounted above the switching device.

The electronic operated switches instead provide that the two devices are provided with respective electronic circuits adapted to interact with each other by sending an identification signal by the circuit associated with the actuator device so as to cause the opening or closing of the main power circuit depending on their reciprocal distance. Examples of electronic actuator switches are described in WO2015083143 and WO2015083144, in the name of the same Applicant, which also comprises centering means for recover possible misalignment between the devices.

The switch also comprises an auxiliary module interposed between the casing housing the switching means designed to be connected to the power supply circuit of the machine or plant and a rotating head that houses the electronic communication circuit and which is also provided with a hole for inserting a centering pin associated with the actuator device.

The auxiliary module is associated with a control manually-operated by an operator to interact with the switching means and/or the driving means in emergency conditions or whenever necessary.

For example, the control may be designed to produce the opening of the switching means in emergency situations or to manually disengage the switch and allow access to the machine or plant.

A same switch may be designed to be coupled with different modules to be implemented with the most suitable control depending on the user's intended use and choices.

EP2362402, always in the name of the same Applicant, describes a switch having a casing housing the switching means and that is adapted to be selectively coupled to actuator modules that differ structurally in a sensitive manner according to their specific function.

This structural difference means that the different modules require a specific design of each part and do not have any degree of interchangeability.

Therefore, the realization of a series of auxiliary modules designed to be applied to the same switch requires the design and production of several components, resulting in increased production costs that are reflected in an increase in the final cost of the switch. A further drawbacks of the known solutions is that the fixing of the casing to the fixed part of the barrier can take place according to a single orientation as the fixing holes are present only on the front face and the rear face.

Therefore, in the case wherein the closing of the movable part does not occur in front of the casing, it is necessary to rotate the head by 90° to allow the interaction between both the centering means and the electronic circuits.

This configuration requires a relatively large number of components and involves a greater axial development of the switching device.

As a consequence, this solution, suitable for particularly complex installations, may be oversized and economically unsuitable for use with simpler machines or installations.

SCOPE OF THE INVENTION

The object of the present invention is to overcome the above drawbacks by providing a modular structure for safety switches for controlling access and/or protections for industrial machines and plants that has high efficiency and relative cost efficiency.

A particular object is to provide a modular structure for safety switches with an auxiliary control module wherein the design and production costs of the different control modules associated with a same switch are greatly reduced.

Yet another object is to provide a modular structure for safety switches requiring a relatively small number of elements for the realization of several control auxiliary modules different in their function.

Last but not least object is to provide a modular structure for safety switches that allows to obtain safety switches with a particularly simple and compact structure in order to reduce production and maintenance costs but at the same time maintain high flexibility in use, being adapted to be associated either with hinged access or sliding access, either of the right or left type.

A particular object is to provide such a modular structure for assembling safety switches that can be anchored to any type of opening without the use of external fixing means such as brackets or the like.

Yet another object is to provide a modular structure for safety switches wherein the drive system is completely electronic in order to guarantee the highest safety standards. Such objects, as well as others that will become more apparent hereinafter, are achieved by a modular structure for safety switches for controlling access of industrial machines and plants which, according to claim 1, comprises a casing anchorable to a fixed part of the access to be controlled and housing thereinside switching means for controlling one or more control and/or service circuits of the machine or plant, driving means adapted to interact with said switching means at the opening/closing of the access for opening/closing one or more circuits, an auxiliary module adapted to be anchored to said casing and housing at least one manually operable control to operate on said switching means and/or said drive means.

The auxiliary module comprises a hollow box body having at least one opening for the insertion of said control, said opening being provided with first connection means for removable connection of said control.

The control is selected within a series of controls having different functions between them and each having a fixing rod which adapted to be inserted in said opening of said box body and provided with second connection means complementary to said first connection means to allow selective assembly of the respective control with said box body according to the function provided for said module.

Thanks to this combination of features, starting from a limited set of elements, it will be possible to assemble the auxiliary module according to a variety of configurations depending on the selected function, as it will be sufficient to change the single control, while maintaining the box body necessary for mounting on the casing.

Consequently, there will be considerable benefits both in terms of design and in terms of cost of realization, resulting in cost savings for the user.

Suitably, said box body of said auxiliary module may have a bottom wall having a central passage provided with means for rotatable anchoring of said module to said casing.

Preferably, the rotating anchoring means may be adapted to allow relative rotation between said module and said casing with a rotation angle greater than or equal to 90° around a central rotation axis while retaining said module and said housing axially constrained.

In this way, it is possible to vary the relative orientation between the module and the casing to independently adapt the respective positions to the specific anchoring mode of the casing to the fixed part of the barrier as well as the position of insertion of the driving means associated with the movable part.

Advantageously, said casing may comprise at least one pair of passages crossing it transversely along respective developing directions incident with each other and adapted to selectively enable the insertion of a member for fixing the casing to a fixed part of the access to be guarded.

In this way, it will possible to adapt the casing position to the specific opening mode of the access and apply ether to hinged opening or sliding openings, either right or left, without the need to provide auxiliary fastening members such as brackets or the like and without that it is necessary to house the driving means and possible centering means within a head orientable relative to the casing.

Suitably, said casing may house thereinside driving means with electronic operation for said switching means.

Moreover, said casing may comprise a centering hole adapted to cooperate with complementary centering means associated with the movable part of the access for recover any misalignments.

Preferably, said casing will be a monolithic body provided with said transverse passages, with said centering hole and with a seat for housing said electronically operate driving means and having a topo annular projection for engaging the central passage of said auxiliary module.

Thanks to this combination of features, a switch with an extremely simple and compact shape can be obtained, minimizing costs while at the same time meeting high security levels and ensuring high reliability.

Advantageous embodiments of the invention are obtained according to the dependent claims.

BRIEF DISCLOSURE OF THE DRAWINGS

Further features and advantages of the invention will become more apparent in the light of the detailed description of some preferred but not exclusive embodiments of a modular structure for safety switches according to the invention, illustrated by way of non-limiting example with the aid of the attached drawings wherein.

Figure 9C:
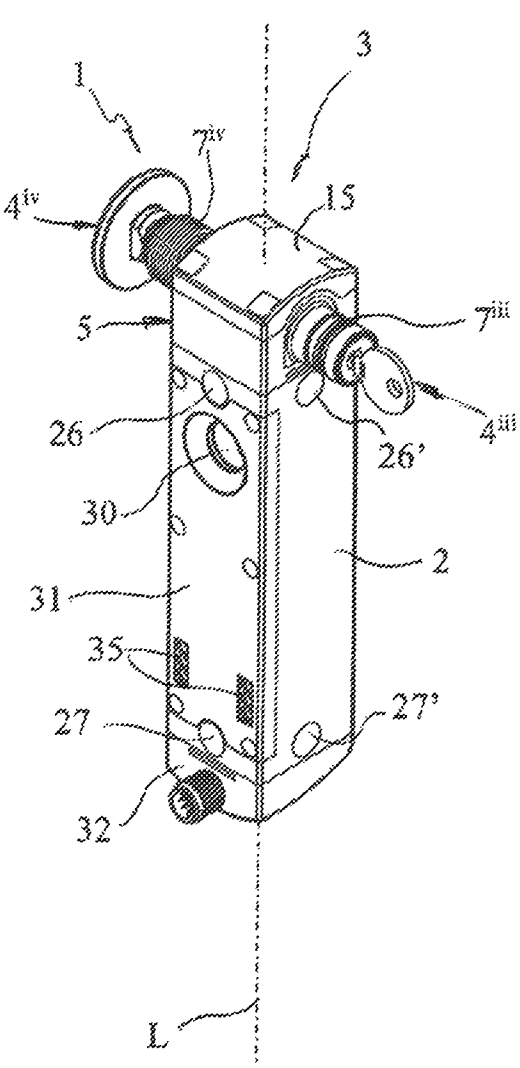
Figure 9B:
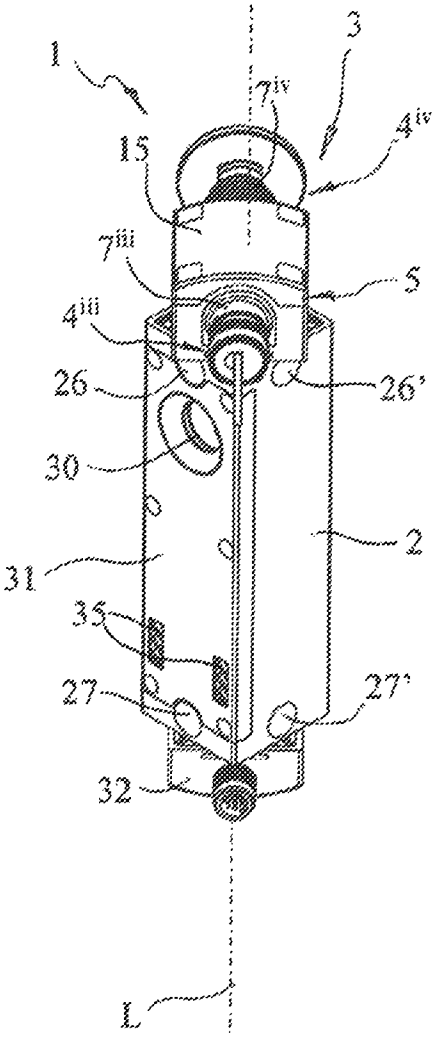
Figure 9A:
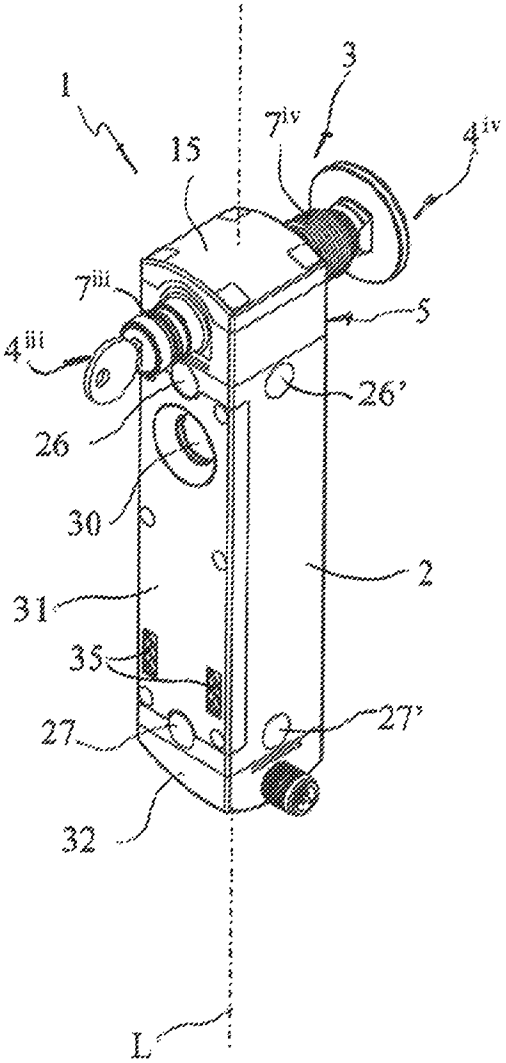

FIGS. from 4 to 8 show some possible preferred embodiments of the auxiliary modules, wherein each module is represented according to a perspective view, a front view and two sections according planes reciprocally orthogonal;

FIG. 9 is a perspective view of an assembled switch with an auxiliary module according to a further embodiment and in a sequence of rotation of the module.

BEST MODES OF CARRYING OUT THE INVENTION

With reference to the accompanying drawings, there are shown some preferred but not exclusive embodiments of a modular structure for realizing safety switches designed to be located at accesses of industrial machines or plants.

The term "access" refers to both door for the access to barrier-type protections and to protection and openable panels, and generally to any movable protection that prevents unsafe access to a working machine or industrial plant.

In a known manner, the assembled switch will be designed to be applied to the protection at an access thereof to substantially stop the operation of the machine or plant in the event of access being opened.

As will be more apparent from the following description, the assembled switch can be applied to both access with hinged opening and sliding opening, either with right or left opening.

Figure 1:
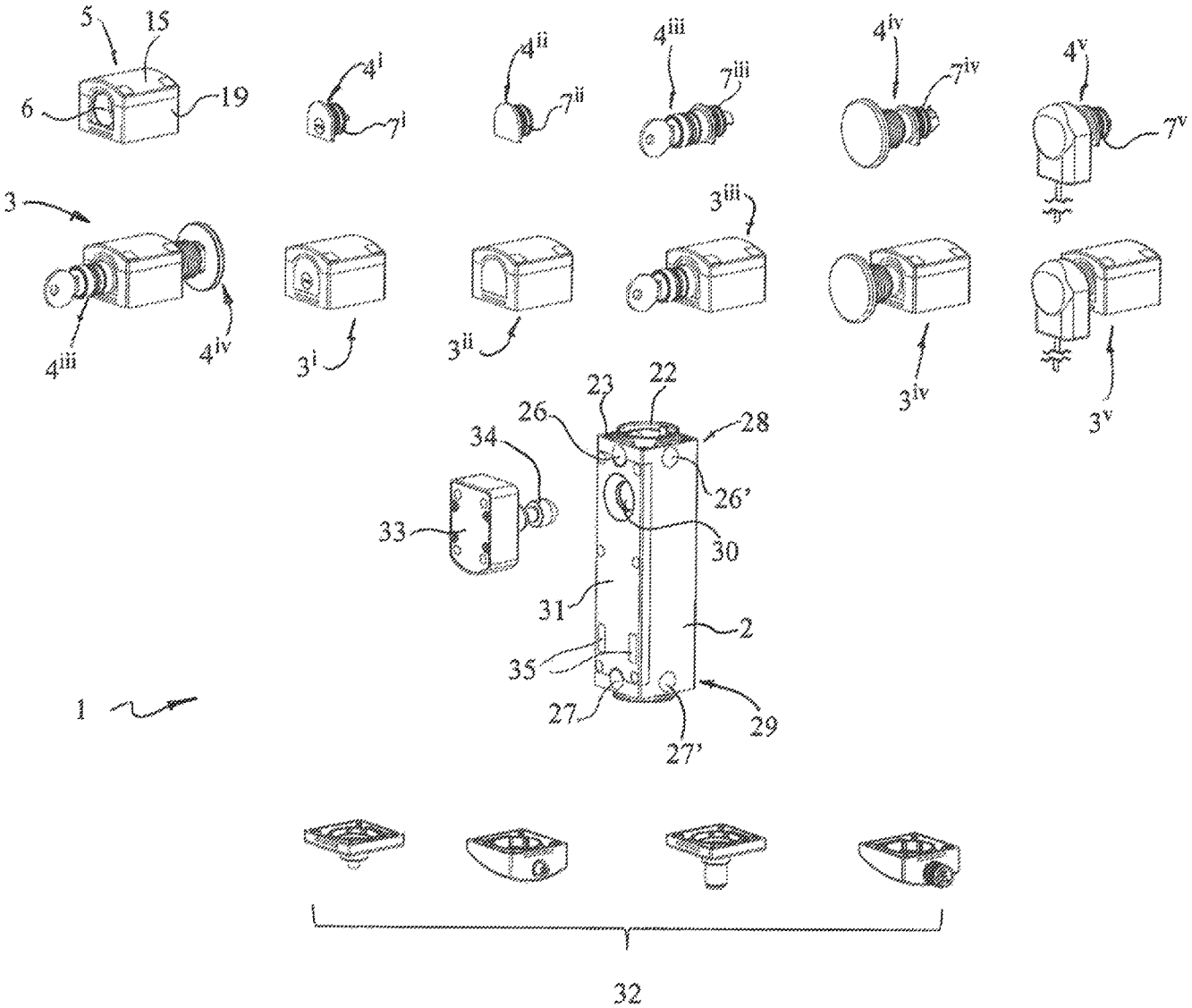
FIG. 1 is a perspective view of the switch structure together with some types of auxiliary modules adapted to be coupled with a same casing.

As can be seen from FIG. 1, a modular structure for safety switches, generally designated by 1, comprises a casing 2 which can be anchored to a fixed portion of the access to be controlled and housing thereinside switching means for controlling one or more control and/or service circuits of the machine or plant.

The switching means, which are not visible from the figures as inside the casing 2, may be selected from those commonly used in the field and may also vary depending on the functionality of the switch without any particular limitations.

Always in a known manner, the switching means are designed to be connected to one or more electrical and/or electronic circuits for power supply and/or control the main circuit and/or service and emergency circuits, not illustrated.

The methods for connecting the switching means to such circuits are of a known type and are not part of the present invention, so they will not be described in more detail below.

Inside the casing 2 there will also be driving means, also not shown, adapted to interact with the switching means upon the opening/closing of the access for opening/closing one or more circuits of the machine or plant following the interaction of the switch with an actuator device 33 generally mounted on the movable part of the access to be controlled.

The assembly of the switch with the structure 1 according to the present invention provides that an auxiliary module 3-3$^{v}$ is anchored to the casing 2 which houses at least one manually operated actuator 4$^{i}$-4$^{v}$ to operate on the switching means and/or on the driving means or other functional element.

For example, in a particular embodiment, shown in FIG. 5, there is provided an auxiliary module 3" which houses a functional element 4" having simply cap function.

In the following, for simplicity, the term "control" will be used to indicate both the proper controls suitable for generating action on the switch and passive functional elements.

The drive of the auxiliary control 4$^{i}$-4$^{v}$ may have the purpose of varying the state of the switching means to obtain the opening of one or more circuits of the machine or plant, for example in emergency conditions or to lock the machine or plant to allow the access thereto or within the protection in a safe mode.

The control 4$^{i}$-4$^{v}$ may also operate on driving means or on any unlocking means adapted to allow the disengaging between the switch mounted on the fixed part of the access and said actuator device 33 mounted on the movable part.

As can be seen from FIG. 1, the auxiliary module 3-3$^{v}$ comprises a hollow box body 5 having at least one opening 6 adapted to allow the insertion of the command 4$^{i}$-4$^{v}$ and having first means for removable connection thereof.

The control 4$^{i}$-4$^{v}$ is selected within a set of controls 4$^{i}$-4$^{v}$ having different functions with each other and each having a fixing rod 7$^{i}$-7$^{v}$ that can be inserted in the opening 6 of the box body 5 and provided with second connecting means complementary to the first connecting means to enable the selective assembly of the respective control 4$^{i}$-4$^{v}$ with the box body 5 according to the function provided for the module 3-3$^{v}$.

FIG. 1 shows six possible configurations for the auxiliary module 3-3$^{v}$, exemplificative but not limiting for the invention.

Figure 2:
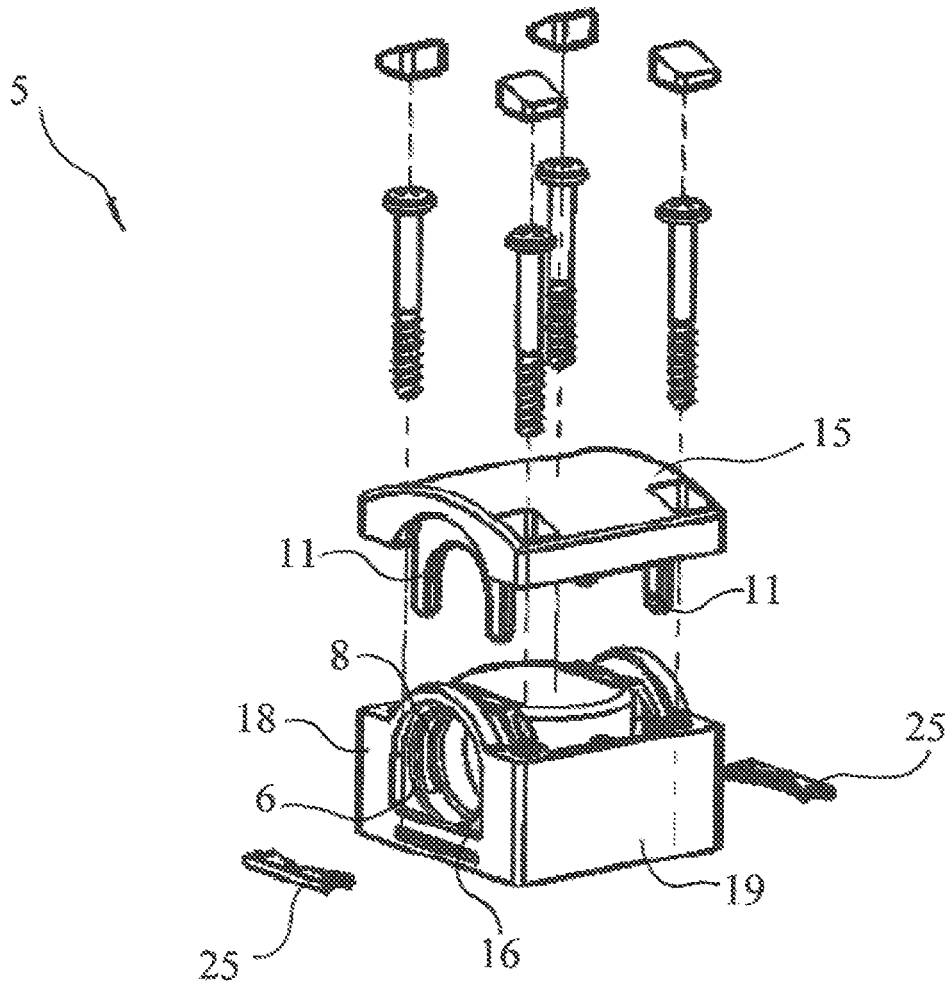
FIG. 2 is an exploded perspective view of the box body of a module according to the invention.
Figure 3A:
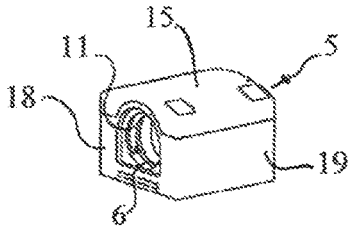
FIG. 3 shows the box body of FIG. 2 according to a perspective view, a front view and two sections according planes reciprocally orthogonal.
Figure 3B:
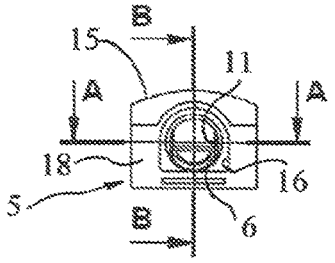
Figure 3C:
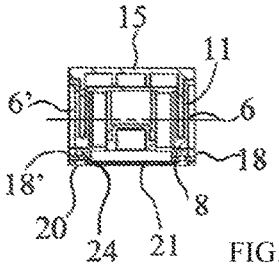
Figure 3D:
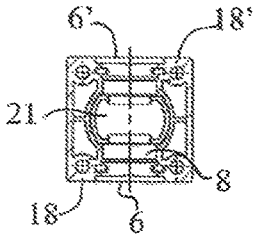
Figure 4A:
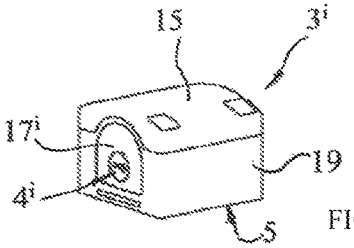
Figure 4B:
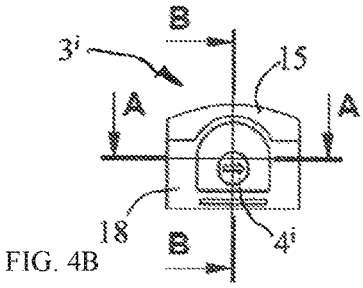
Figure 4C:
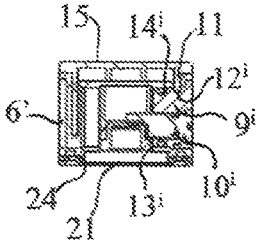
Figure 4D:
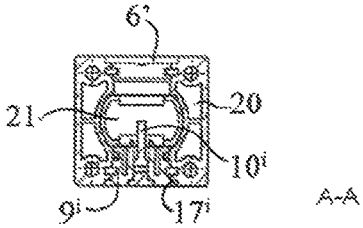
Figure 5A:
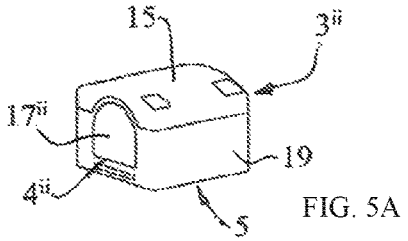
Figure 5B:
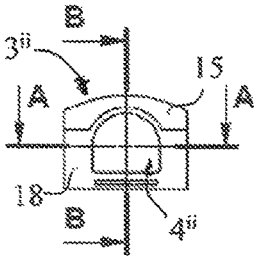
Figure 5C:
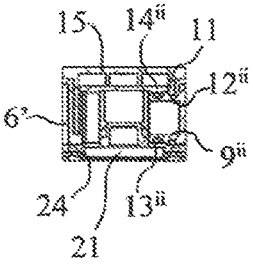
Figure 5D:
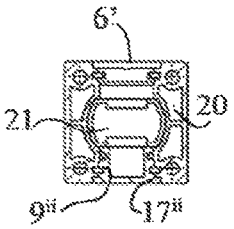
Figure 6A:
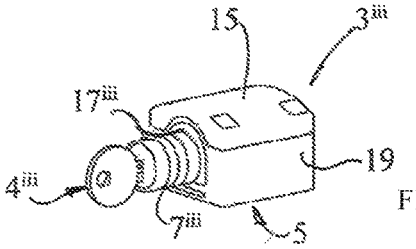
Figure 6B:
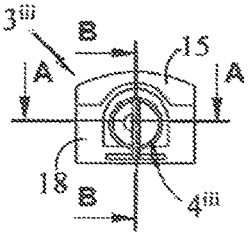
Figure 6C:
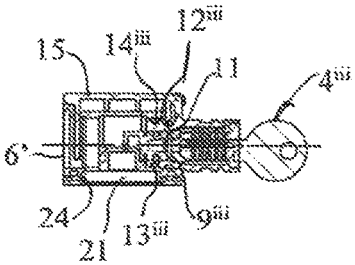
Figure 6D:
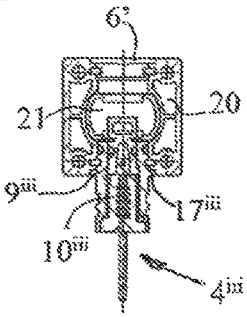
Figure 7A:
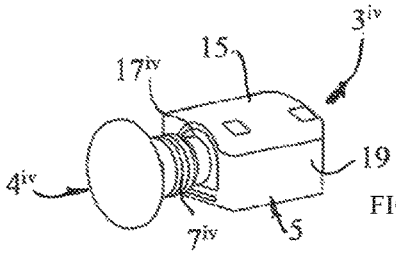
Figure 7B:
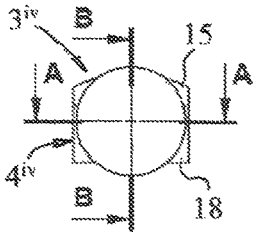
Figure 7C:
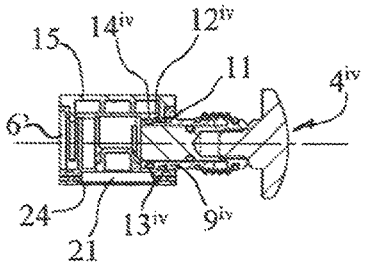
Figure 7D:
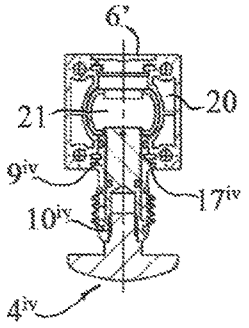
Figure 8A:
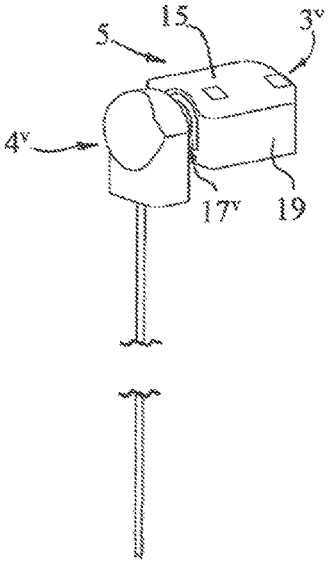
Figure 8B:
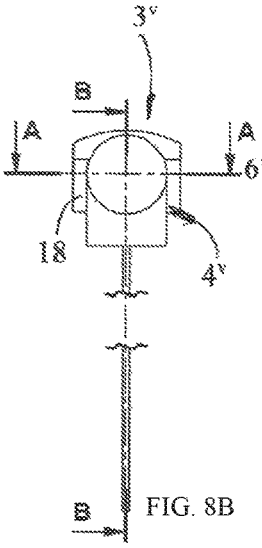
Figure 8C:
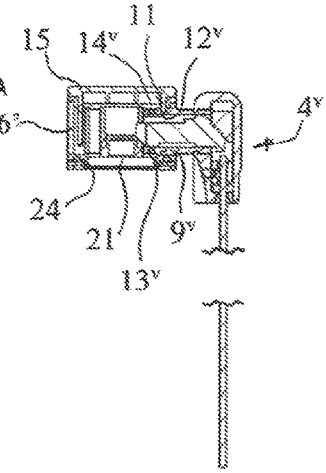
Figure 8D:
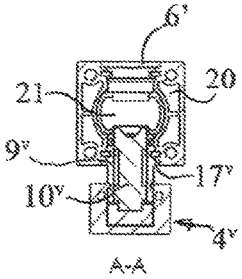

Each configuration may be obtained by selectively coupling one or more of the controls 4$^{i}$-4$^{v}$ with a same box body 5, illustrated more clearly in the exploded configuration of FIG. 2.

Although from an operational point of view the switch will usually be supplied already assembled in the configuration required by the user, it is not excluded that the switch may be supplied in a partially disassembled condition and provided with a set of controls 4$^{i}$-4$^{v}$ and one or more box bodies 5 so as to enable the user to assemble the switch according to his needs.

This will allow to achieve significant economic savings as the user will not be forced to purchase a large number of switch already assembled but may eventually replace only the control of the auxiliary module.

As can be seen more clearly from the sections of FIG. 3, the first connecting means of the box body 5 are defined by a molded seat 8 formed inside the box body 5 close to the opening 6 and accessible through it.

From the sections of FIGS. 4 to 8 it is noted that the second connecting means of each command 4$^{i}$-4$^{v}$ will be defined by a portion 9$^{i}$-9$^{v}$ of the fixing rod 7$^{i}$-7$^{v}$ having a complementary shape to that of the shaped seat 8 to fit in to the same.

In particular, each control 4$^{i}$-4$^{v}$ will comprise a rod 7$^{i}$-7$^{v}$ which will in general have a different shape with respect of the rods 7$^{i}$-7$^{v}$ of the other commands 4$^{i}$-4$^{v}$. In each rod 7$^{i}$-7$^{v}$, however, it is possible to identify a substantially cylindrical portion 9$^{i}$-9$^{v}$ countershaped with respect to the seat 8 and whose outer profile will be identical to the outer profiles of the corresponding contiguous portions 9$^{i}$-9$^{v}$ of the rods 7$^{i}$-7$^{v}$ of the other controls 4$^{i}$-4$^{v}$ of the series to allow their selective anchorage to the same box body 5.

At its inside, the rod 7$^{i}$-7$^{v}$ will be shaped according to the specific functions of each control 4$^{i}$-4$^{v}$ and generally will have tubular shape to house a movable element 10$^{i}$-10$^{v}$ designed to interact with the switching means, driving means or unlocking means of the switch according to known way for the expert.

As can be seen more clearly from the sections along the B-B planes of the various modules 3-3$^{v}$, the shaped seat 8 of the box body 5 has at least one U-shaped radial peripheral projection 11 which is adapted to enter into a peripheral groove 12$^{i}$-12$^{v}$ of the countershaped portion 9$^{i}$-9$^{v}$ of the rod 7$^{i}$-7$^{v}$ inserted from time to time thereinside. The countershaped portions 9$^{i}$-9$^{v}$ also present a further peripheral groove 13$^{i}$-13$^{v}$ housing an annular sealing gasket 14$^{i}$-14$^{v}$.

The box body 5 may be monolithic, but preferably it will be provided with a removable top lid 15 from which the radial peripheral projection 11 will extend to block the rod 7$^{i}$-7$^{v}$.

In addition, the opening 6 has a recessed edge 16 defining a front abutment for a flange 17$^{i}$-17$^{v}$ of the countershaped portion 9$^{i}$-9$^{v}$ of the rod 7$^{i}$-7$^{v}$ having a complementary contour profile with respect to the opening 6 so as to be flush with the front face 18 of the box body 5.

Suitably, the box body 5 will have a side wall 19 having opposite front faces 18, 18' with respective openings 6, 6' and with substantially symmetrical shape with respect to a first median plane parallel to the front faces 18, 18' and to a second median plane orthogonal to the first and parallel in use to the longitudinal extension axis L of the casing 2.

In this way, the box body 5 may house a pair of controls 4$^{i}$-4$^{v}$ having different functions, as shown in FIG. 9, wherein the module 3 is provided with a first control 4$^{iii}$ defined by a key switch and a second control 4$^{iv}$ defined by a mushroom emergency button.

The box body 5 has a bottom wall 20 having a central passage 21 provided with means for rotatable anchoring the module 3-3$^{v}$ to the casing 2 so as to allow their relative rotation with respect of the same longitudinal axis L of the casing 2, as outlined in FIG. 9.

The rotatable anchoring means will allow relative rotation between the module 3-3$^{v}$ and the housing 2 about the central rotation axis L and at the same time hold the module 3-3$^{v}$ and the casing 2 axially fastened to avoid their decoupling.

In an exemplary manner, the rotatable anchorage will be obtained by providing an annular shaped axial projection 22 on the upper face 23 of the casing 2 which will engage a peripheral groove 24 of the box body 5 arranged at the central passage 21. According to a first variant, both the axial projection 22 and the peripheral groove 24 may be provided with respective non-illustrated abutment elements adapted to limit the maximum rotation to a value lower than 360° to prevent twirling of possible wires connecting the control 4$^{i}$-4$^{v}$ to the switching means.

In another variant there won't be means limiting the rotation, the value of which may be equal to or greater than 360°.

The axial constraint may be made by one or more tabs 25 adapted to fit into the peripheral groove 24 to prevent reciprocal axial movement, without limiting rotation. According to a further particularly advantageous aspect, the casing 2 is provided with means for allowing it to be fixed to the fixed part of the barrier according to at least two different reciprocally rotated orientations.

In particular, the anchoring means are integrated in the casing 2 and are adapted to allow the selective fixing to the fixed part of the access without the need for additional supports such as brackets or the like.

Preferably, the anchoring means will be designed to allow the anchorage of the casing 2 according to at least three different orientation planes rotated with each other by 90° around a common central axis defined by the main extension longitudinal axis L of the casing 2.

In the illustrated configuration, the anchoring means consist of two pairs of passages 26, 26'; 27, 27' crossing therethrough along respective reciprocally orthogonal development directions and adapted to allow selective insertion of a fixing member such as a screw, pin or the like, not illustrated, adapted to fix the casing to the fixed part of the access.

In particular, there is a first pair of passages 26, 26' at the upper longitudinal end 28 of the casing 2 and a second pair of passages 27, 27' at the lower longitudinal end 29.

More precisely, two passages 26, 27 will be made frontally and two passages 26', 27' will be made laterally.

The anchoring of the casing 2 to the fixed part of barrier may be obtained, in the case of a hinged opening, by inserting two fastening members in the two frontal passages 26, 27 while with a sliding opening the fastening members will be inserted through the two side passages 26', 27'.

The front passages 26, 27 and the side passages 26', 27' of each pair mutually intersect so that the fixing height of the casing 2 does not depend on the anchoring orientation. The switch illustrated in the figures is of the electronic drive type, i.e. the action of the driving means on the switching means is controlled by an electronic signal transmitted to the switching means according to known modes and described for example in the aforementioned WO2015083143.

To this end, the driving means will comprise a first electronic circuit that comprises an RFID antenna housed inside the same casing 2 in a suitable seat provided thereinto.

The antenna is designed to receive a remote control signal, that is, a presence signal transmitted by a second electronic circuit housed in the movable actuator 33, when the latter is at a predetermined minimum distance from the switching means such that the access could be considered safely closed.

In particular, the second electronic circuit, not visible from the figures, will be provided with a tag having a recognition code that must be recognized by the first circuit in order to allow the start of the machine or plant. Code recognition can be unique or generic, depending on whether you want to achieve a high or low encoding level switch.

The casing 2 is also provided with a centering hole 30 adapted to cooperate with a centering pin 34 extending from the actuator device 33 to allow the at least partial recovery of the alignment between the first and the second electronic circuit in the case where during mounting phase the alignment between the parts has not been correctly carried out, or is lost during use.

The centering hole 30 has a flared inlet to define an invitation for the pin and to provide a greater surface for recovering more accentuated misalignments.

In essence, the casing 2 will be a monolithic body provided with transverse passages 26, 26'; 27, 27', with the centering hole 30 and with the seat for housing the antenna of the first electronic circuit.

In addition, the casing 2 will be provided with a removable lid 31 for access to is inside and thus to the switching means. In a not shown variant, the casing 2 will be without the lid 31 and therefore will not allow access to it.

The casing 2 may also be made entirely of plastic material in order to further reduce the cost. In this case, the centering hole 30 may have a metallic ring at its flared inlet, in order to provide greater resistance to impact with the pin.

The casing 2 may also be provided with one or more signaling lights 35, preferably of LED type, indicating the state of the different circuits connected to the switch 1.

At the lower end 29 of the casing 2, a connection module 32 selected between a plurality of different connection modules may be provided, also having means for electrical or electronic connection of the switching means for controlling the circuits of the machine or plant, such as multi-pole connectors, cable connectors or the like.

The connection module 32 is adapted to be selectively mounted to the lower longitudinal end 29 of the casing 2 in a rotatable manner to rotate about a longitudinal rotation axis L.

From above it is apparent that the modular structure for safety switches according to the invention achieves the predetermined objects and in particular that of allowing significant economic savings during the design and manufacture of the switches.

The structure according to the invention is susceptible of numerous modifications and variations, all of which fall within the inventive concept expressed in the appended claims. All details may be replaced by other technically equivalent elements, and the materials may be different according to the needs without departing from the scope of the present invention.

Although the structure has been described with particular reference to the attached figures, the reference numbers used in the description and claims are used to improve the intelligence of the invention and do not constitute any limitation to the claimed scope.

The invention claimed is:

1. A modular structure for safety switches for controlling access for machines and industrial plants, comprising:

a casing (2) adapted to be anchored to a fixed part of the access to be controlled for controlling one or more control and/or service circuits of the machine or plant;

a series of controls ($\mathbf{4}^{i}$-$\mathbf{4}^{v}$);

an auxiliary module ($\mathbf{3}$-$\mathbf{3}^{v}$) adapted to be anchored to said casing (2) and housing at least one of the series of controls ($\mathbf{4}^{i}$-$\mathbf{4}^{v}$) adapted to be manually operated;

wherein said auxiliary module ($\mathbf{3}$-$\mathbf{3}^{v}$) comprises a hollow box body (5) having at least one opening (6) for inserting said at least one control ($\mathbf{4}^{i}$-$\mathbf{4}^{v}$), said opening (6) being provided with a first connecting means for removably connecting said at least one of the series of controls ($\mathbf{4}^{i}$-$\mathbf{4}^{v}$), the first connecting means comprising a shaped housing seat (8), wherein each of said series of controls ($\mathbf{4}^{i}$-$\mathbf{4}^{v}$) is provided with a fastening rod ($\mathbf{7}^{i}$-$\mathbf{7}^{v}$) adapted to be inserted in said opening (6) of said box body (5), the fastening rod ($\mathbf{7}^{i}$-$\mathbf{7}^{v}$) having a second connecting means complementary to said first connecting means for allowing the selective assembly of the respective control ($\mathbf{4}^{i}$-$\mathbf{4}^{v}$) of the series of controls ($\mathbf{4}^{i}$-$\mathbf{4}^{v}$) with said box body (5) based on the designed function of said module ($\mathbf{3}$-$\mathbf{3}^{v}$), the second connecting means defined by respective counter-shaped portions ($\mathbf{9}^{i}$-$\mathbf{9}^{v}$) whose external profiles are identical to each other for their selective anchoring to a same box body (5), wherein each fastening rod ($7^i$-$7^v$) of each of the respective controls ($4^i$-$4^v$) also comprises a portion defined by a shape that differs from one another among respective controls ($4^i$-$4^v$) of the series of controls ($4^i$-$4^v$) to enable assembly of the auxiliary module housing one of the controls ($4^i$-$4^v$) according to a function of the auxiliary module.

2. Modular structure as claimed in claim 1, wherein the shaped housing seat (8) is accessible from said opening (6), said fastening rods ($7^i$-$7^v$) having a counter-shaped portion ($9^i$-$9^v$) complementarily shaped with respect of said shaped housing seat (8) to be snugly fit thereinto.

3. Modular structure as claimed in claim 2, wherein said shaped housing seat (8) has at least one radial peripheral projection (11) adapted to be inserted in a peripheral groove ($12^i$-$12^v$) of said counter-shaped portion ($9^i$-$9^v$) of a respective one of said fastening rods ($7^i$-$7^v$).

4. Modular structure as claimed in claim 3, wherein said box body (5) comprises a removable top lid (15) provided with said radial peripheral projection (11).

5. Modular structure as claimed in claim 2, wherein said opening (6) has a recessed edge (16) defining a front abutment for a flange ($17^i$-$17^v$) of said counter-shaped portion ($9^i$-$9^v$) of said rod ($7^i$-$7^v$) having a complementarily shaped profile with respect to said opening (6).

6. Modular structure as claimed in claim 1, wherein said box body (5) of said auxiliary module ($3$-$3^v$) has a side wall (19) having opposite front faces (18, 18') provided with respective openings (6, 6') and at least substantially symmetrical shape with respect to a median plane parallel to said front faces (18, 18') to house a pair of controls ($4^i$-$4^v$) of said series.

7. Modular structure as claimed in claim 1, wherein said box body (5) of said auxiliary module ($3$-$3^v$) has a bottom wall (20) with a central passage (21) associated with means for rotatably anchoring said auxiliary module ($3$-$3^v$) to said casing (2).

8. Modular structure as claimed in claim 7, wherein said means for rotatably anchoring said auxiliary module ($3$-$3^v$) are adapted to allow rotation between said auxiliary module ($3$-$3^v$) and said casing (2) with a rotation angle equal to or greater than 90° about a central axis of rotation (L) holding said module ($3$-$3^v$) and said casing (2) axially constrained.

9. Modular structure as claimed in claim 7, wherein said casing (2) comprises at least one pair of passages (26, 26'; 27, 27') crossing it transversely along respective extension directions incident with each other.

10. Modular structure as claimed in claim 1, wherein said casing (2) comprises a centering hole (30) adapted to cooperate with a complementary centering means associated to a movable part of the access for recovery of possible misalignments.

11. Modular structure as claimed in claim 9, wherein said casing (2) is a monolithic body provided with said transverse passages (26, 26'; 27, 27'), a centering hole (30) and with a seat for housing an electronic driving means and having an upper annular protrusion (22) adapted to engage the central passage (21) of the bottom wall (20) of the box body (5) of said auxiliary module ($3$-$3^v$).

12. Modular structure as claimed in claim 1, wherein said casing (2) has an upper longitudinal end (28) and a lower longitudinal end (29), further comprising one or more of electrical connection modules (32) adapted to be selectively mounted at the lower longitudinal end (29) of said casing (2), said one or more electrical connection modules (32) being adapted to be optionally mounted in a rotatable manner on said casing (2) to rotate about a longitudinal axis of rotation (L).

* * * * *